United States Patent [19]

Mascia et al.

[11] 4,171,743

[45] Oct. 23, 1979

[54] BAND INTEGRATED DOUBLE SERVING PACKAGES WITH HOOK

[75] Inventors: Carmen T. Mascia, Clarendon Hills; Thomas F. Jordan, Oak Park, both of Ill.

[73] Assignee: The Continental Group, Inc., New York, N.Y.

[21] Appl. No.: 938,618

[22] Filed: Aug. 31, 1978

[51] Int. Cl.[2] ..... B65D 65/22; B65D 75/24

[52] U.S. Cl. ..... 206/527; 220/4 E; 206/806

[58] Field of Search ..... 220/4 R, 4 A, 4 B, 4 E, 220/4 C, 4 D, 4 F, 305, 306, 94 B, 95, 319, 320, 321; 206/527

[56] References Cited

U.S. PATENT DOCUMENTS

| | | | |
|---|---|---|---|
| Re. 24,889 | 10/1960 | Tupper | 220/306 X |
| 239,225 | 3/1881 | Claussen | 220/4 E |
| 857,680 | 6/1907 | Schulz | 220/4 B |
| 1,921,015 | 8/1933 | Young | 220/4 E |
| 2,681,142 | 6/1954 | Cohen | 220/4 E |
| 3,360,153 | 12/1967 | Wheaton | 220/4 B |
| 3,429,629 | 2/1969 | Cilia | 220/4 B |

FOREIGN PATENT DOCUMENTS

| | | | |
|---|---|---|---|
| 2237745 | 2/1974 | Fed. Rep. of Germany | 220/4 E |
| 618912 | 3/1944 | United Kingdom | 220/4 R |
| 308928 | 9/1971 | U.S.S.R. | 220/4 E |

*Primary Examiner*—William T. Dixson, Jr.
*Attorney, Agent, or Firm*—Charles E. Brown

[57] ABSTRACT

A display package which is formed of a pair of serving packages each including a bowl-like container with a removable cover. The covers are interlocked with the containers and require outward radial expansion for removal. The serving packages are arranged with the covers in face-to-face engagement and are joined together by a circumferential band shrunk in place and interlocked behind the covers. A separately formed hook of the bent wire type has a loop receiving the band and serves as hanging means for the package.

3 Claims, 3 Drawing Figures

BAND INTEGRATED DOUBLE SERVING PACKAGES WITH HOOK

This invention relates in general to new and useful improvements in display packages, and most particularly to a display package which is formed by placing two serving packages in face-to-face engagement and securing them together with a shrink band.

It is known to form a combination package for sales purposes of two cans seated one on top of the other, the cans being secured together for sale as a unit by means of an encircling tape. These cans are seated on a shelf in a customary manner for display.

It is also known to provide a tape which may be attached to an article to facilitate the carrying of the same, the tape being provided with an integral handle. Such an arrangement is disclosed in U.S. Pat. No. 2,236,681 to Goldschmidt.

It is also known to provide shrink tapes for enclosing articles, attaching the articles to a suitable backing for display. This is disclosed in U.S. Pat. No. 3,214,010 to Sunshine.

This invention particularly has to do with the displaying of bowl-type containers wherein the containers are provided with removable covers. The covers are generally interlocked with flanges on the containers, and the interlock is such that the covers must be radially outwardly expanded in order to effect the removal thereof.

In accordance with this invention, the containers are arranged with the covers in face-to-face relation, and then are joined together by a band which tightly encircles the adjacent portions of the serving packages and interlocks behind the covers. The band is preferably in the form of a shrink band.

In order to facilitate the hanging of the joined-together serving packages, there is provided a hook generally of the bent wire type having one loop encircling the band, the loop being clamped tightly against the serving packages by the band.

The loop may have a base which seats on the covers of the serving packages, and serves to form an interlock therewith to aid in the prevention of the separation of the covers.

With the above and other objects in view that will hereinafter appear, the nature of the invention will be more clearly understood by reference to the following detailed description, the appended claims, and the several views illustrated in the accompanying drawings.

IN THE DRAWINGS

Figure 2:
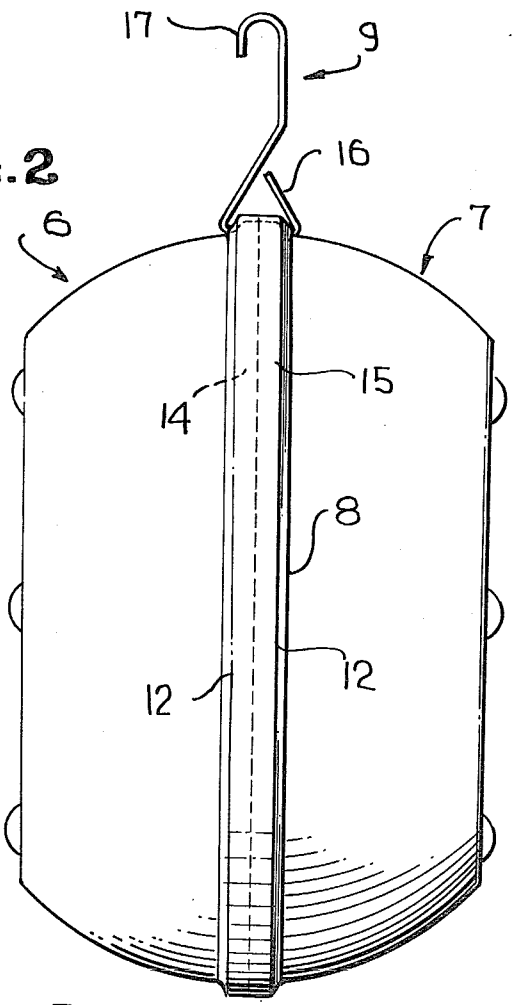
FIG. 2 is an end elevational view of the display package of FIG. 1.

Referring not to the drawings in detail, it will be seen that the display package formed in accordance with this invention is generally identified by the numeral 5. The display package 5 is basically made up of two identical serving packages 6, 7 which are arranged in face-to-face relation and which are joined together by a band 8. The band 8 carries a hook, generally identified by the numeral 9, for hanging the display package.

Figure 3:
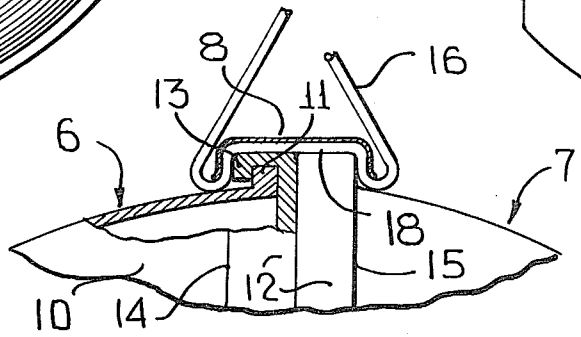
FIG. 3 is an enlarged vertical sectional view taken generally along the line 3—3 of FIG. 1, and shows more specifically the details of the serving packages and the interlocking relationship of the band and hook therewith.
Figure 1:
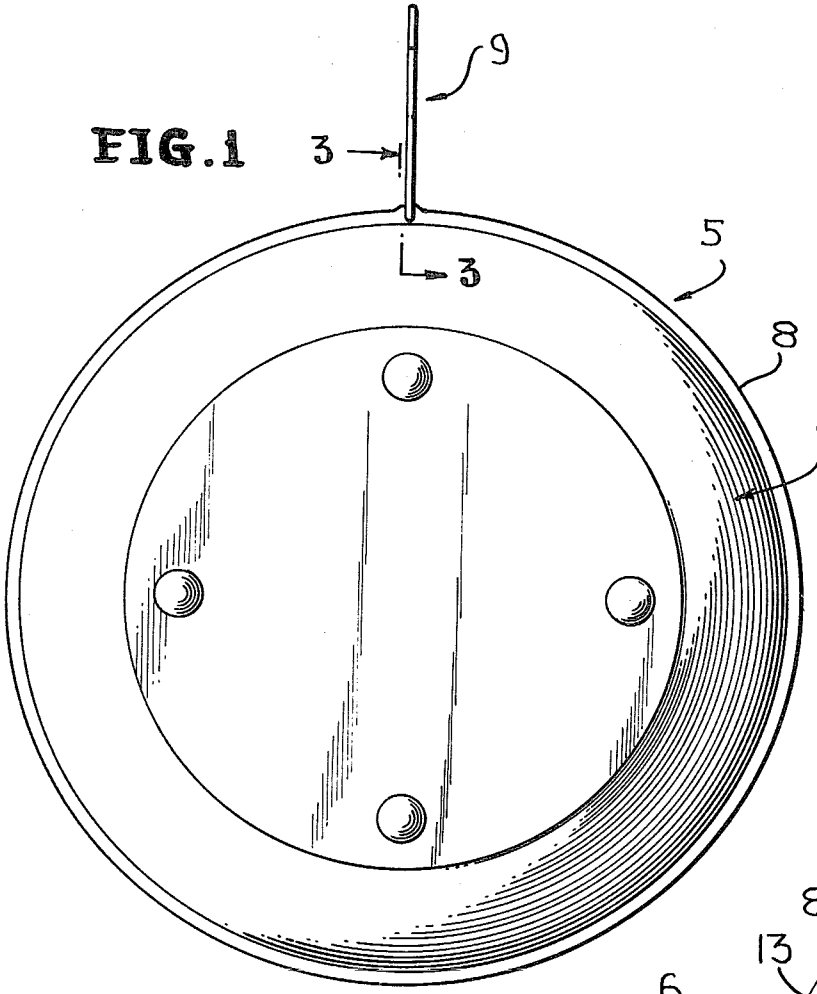
FIG. 1 is a side elevational view of the display package formed in accordance with this invention.

Referring now to FIG. 3 in particular, it will be seen that the serving packages 6, 7 are of a conventional construction and each includes a generally bowl-like container 10 having a peripheral flange 11. Each container 10 carries a removable cover 12 which has a peripheral rim 13 interlocked around the flange 11. It is to be noted that the relationship between each cover 12 and its respective container 10 is such that the cover 12 can be separated from the container 10 only by a radially outwardly directed expansion of the rim 13.

Most specifically, the serving packages 6, 7 are arranged with the covers 12 thereof in face-to-face relation. When the serving packages 6, 7 are so arranged, the covers 12 thereof define oppositely facing shoulders 14, 15. The band 8, which is preferably in the form of a band of heat shrinkable plastics material, is placed around the two adjacent portions of the serving packages 6, 7 and is shrunk into place. As is clearly shown in FIG. 2, the band 8 will interlock behind the shoulders 14, 15 of the covers 12 and serve to securely maintain the serving packages 6, 7 as a unit until the serving packages are separated by rupturing the band 8 or otherwise pulling the band away from the serving packages.

It being the desire to suspend the joined-together serving packages 6, 7 as a display unit, the hook 9 is provided. The preferred embodiment of the hook 9 is an inexpensive wire hook having formed at the inner end thereof a loop 16 and at the outer end thereof a hook portion 17. The loop 16 encircles the band 8 and thus provides for a positive interlock between the joined-together serving packages 6, 7 and the hook 9.

With particular reference to FIG. 3, it will be seen that the loop 16 has a base portion 18 of a generally inverted channel shape, with the base portion 18 being seated on the covers 12 and engaging the shoulders 14, 15 thereof further to hold the covers 12 together.

It is to be understood that the hook 9 could also be readily injection molded or otherwise formed of a suitable plastics material.

It will be readily apparent that the display package 5 may be economically formed in that all that is necessary is for the band 8 to be provided in addition to the hook 9, and that the loop 16 be interlocked with the band 8 after which the band 8 is positioned around the interposed serving packages and the band 8 shrunk into place through the application of heat.

Although only a preferred embodiment of the display package has been specifically illustrated and described herein, it is to be understood that minor variations may be made in the display package without departing from the spirit and scope of the invention as defined by the appended claims.

We claim:

1. A display package comprising a pair of serving packages arranged in face-to-face relation, a band extending around adjacent portions of said serving packages, and a hook carried by said band for hanging the display packages, said hook being of the bent wire type and including a loop transversely encircling the entire cross section of said band.

2. A display package according to claim 1 wherein said band is a shrink band.

3. A display package according to claim 1 wherein said serving packages each include a container and a removable cover, said covers are in said face-to-face relation, said band is interlocked behind peripheral edges of said cover, and said loop has a base portion interlocked with said covers.

* * * * *